US005255589A

United States Patent [19]

Caulkins

[11] Patent Number: 5,255,589

[45] Date of Patent: Oct. 26, 1993

[54] CALLIOPE PIPE CONVERTER, ASSEMBLY, AND METHOD

[76] Inventor: Kenneth B. Caulkins, 4218 Jessup Rd., Ceres, Calif. 95307

[21] Appl. No.: 817,072

[22] Filed: Jan. 6, 1992

[51] Int. Cl.[5] ..... G10D 7/00

[52] U.S. Cl. ..... 84/330; 84/349; 116/137 R

[58] Field of Search ..... 84/330, 349, 456, 452 P; 116/137 R, 140; 446/416, 397; 285/177

[56] References Cited

U.S. PATENT DOCUMENTS

| | | | |
|---|---|---|---|
| 161,912 | 4/1875 | Taplin | 285/177 |
| 290,045 | 12/1883 | Hardy | 285/177 |
| 429,067 | 5/1890 | Simmons | 285/177 |
| 552,612 | 1/1896 | Frost | 446/416 |
| 1,197,302 | 9/1916 | Ori | 84/330 |
| 1,449,211 | 3/1923 | Baker | 116/137 R |
| 1,725,025 | 8/1929 | Sylvia | 84/330 |
| 4,619,177 | 10/1986 | Caulkins . | |
| 4,733,592 | 3/1988 | Caulkins . | |
| 5,027,685 | 7/1991 | Lenz | 84/330 |

*Primary Examiner*—Michael L. Gellner
*Assistant Examiner*—Cassandra C. Spyrou
*Attorney, Agent, or Firm*—Kerkam, Stowell, Kondracki & Clarke

[57] ABSTRACT

A converter allows one to use common PVC pipes for making a musical pipe. The converter has a beveled edge such that one need not provide a separate beveled edge tube for each note, but one may simply use the same converter on various tubes of different lengths in order to produce different notes. The converter is used to produce a calliope pipe. A valve arrangement cooperates with the converter and sound pipe in order to allow one to individually control the sound of a particular musical or sound pipe.

10 Claims, 3 Drawing Sheets

FIG. 7
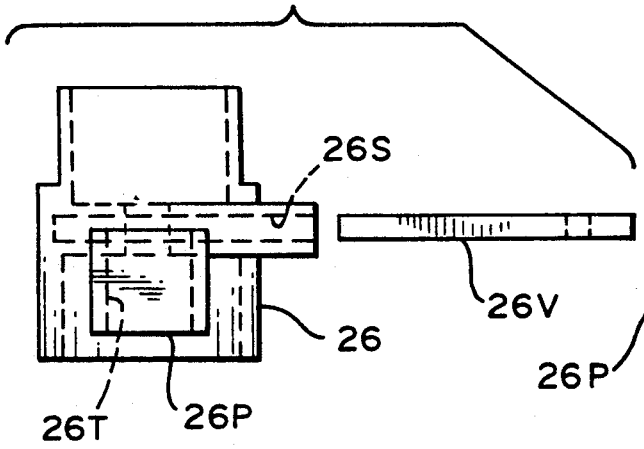
FIG. 8
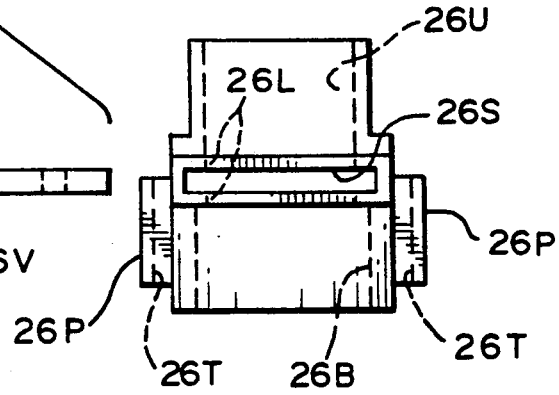
FIG. 9
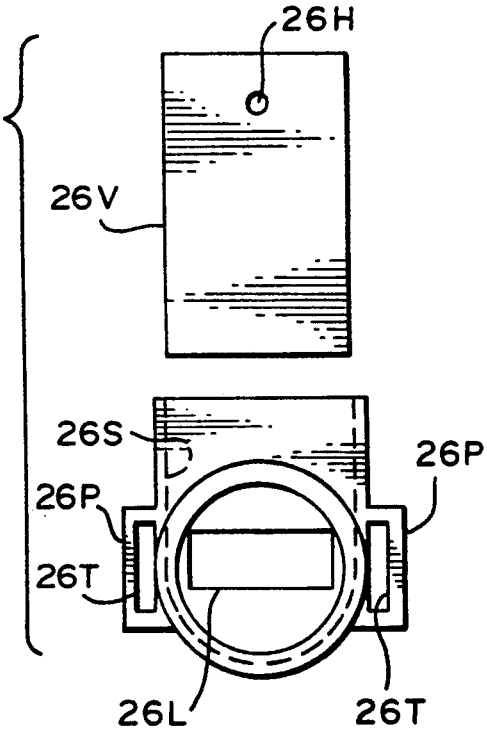
FIG. 11
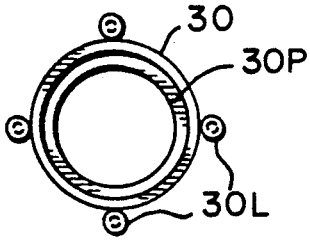
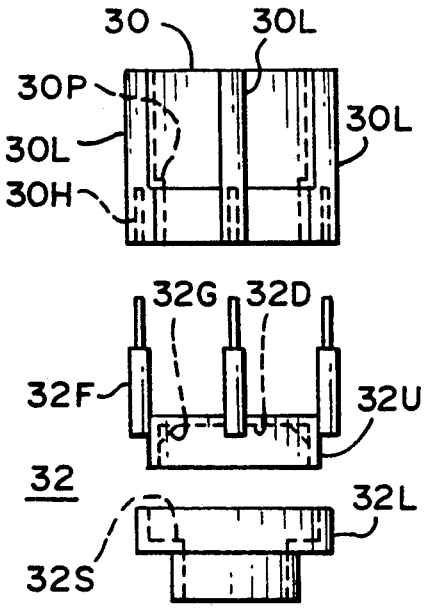
FIG. 10

CALLIOPE PIPE CONVERTER, ASSEMBLY, AND METHOD

BACKGROUND OF THE INVENTION

This invention relates to a converter for allowing standard polyvinyl chloride (PVC) pipe to be used as the pipe in a calliope. This invention further relates to a musical instrument assembly made with that converter and a method of making a musical instrument assembly with such a converter. Various musical instruments have used pipes to generate notes. In particular, the frequency of the note has depended upon the resonance established within air inside of a pipe or tube. Among such instruments have been pipe organs and calliopes.

In a pipe organ, a note is established by pressurized air supplied to one of numerous pipes, each of which generally corresponds to a single note. An opening, which usually covers only a small portion of the circumference of the pipe, allows sound to escape from the pipe. It is difficult to control the sound of the note from the pipes of a pipe organ. Increasing or decreasing the pressure of the air supplied to the pipe may change the volume, but it will also change the note which is produced. To control the volume, wooden louvers have sometimes been used.

Calliope pipes have an opening or mouthpiece which essentially extends around 360° of the pipe. Such structures usually have a tube in which a resonance is established. The tube has a plug inside to close off one end. The opposite end of the tube has a mouthpiece mounted thereon. The mouthpiece has a series of offset members which are mounted to the outside of the tube. The mouthpiece has a disc therein and openings extended around the disc such that pressurized air may flow out through the openings and strike a beveled edge of the tube, which establishes the resonance between the disc of the mouthpiece and the plug within the tube. The opening between the beveled edge of the tube and the disc of the mouthpiece essentially extends around 360° with the exception of very small portions at which the offset members are disposed. This allows one to change the volume by changing the air pressure as such changes in air pressure will be much less likely to significantly affect the frequency of the note than in the case of a pipe organ pipe.

Although one can adjust the volume of a calliope by adjusting the pressure of the air supplied to it, a calliope typically has a large number of pipes. Adjusting the air pressure at the source will change the volume of all of the notes. In other words, it has been impossible or difficult to individually adjust the volume of the different pipes within a calliope.

Assembling a calliope has typically required one to weld or otherwise secure offset members of a metallic mouthpiece to a metallic tube. The tube length must be accurately controlled in order to provide the desired note. Upon having a tube of the correct length, one must then make a beveled edge at the mouthpiece end of the tube. The need to make a beveled edge in a tube of the proper length increases the difficulty in making a calliope.

OBJECTS AND SUMMARY OF THE INVENTION

Accordingly, it is a primary object of the present invention to provide a new and improved musical instrument.

A more specific object of the present invention is to provide a converter which allows one to use ordinary PVC pipes for sounding a musical note.

A further object of the present invention is to provide a musical instrument where one need not bevel the edge of a pipe, but instead may use a beveled edge on a converter which may accommodate numerous different lengths of pipes.

A still further object of the present invention is to provide an apparatus in which individual control of the sound volume of a pipe may be provided. (Individual control is used to mean control of the volume of a single pipe without changing the volume of other pipes.)

Yet another object of the present invention is to provide a pipe which may be readily tuned.

A still further object of the present invention is to provide a new and improved method for making a musical instrument.

The above and other objects of the present invention which will become more apparent as the description proceeds are realized by a converter for converting a PVC pipe into a musical instrument sound pipe. The converter has a first portion with a first hole which is generally cylindrical for holding a PVC pipe therein, a second portion with a second hole therein, the second hole being in line with the first hole, and an interior stop in between the first hole and the second hole. The second portion has a cylindrical outer edge which is beveled outwardly such that a PVC pipe may sound a musical note when disposed in the first hole. The second portion is adapted to secure offset members of a mouthpiece thereto. The second hole is cylindrical and the interior stop is a ring corresponding to a difference in diameter of the first hole and the second hole. The first portion and the second portion have generally cylindrical outer surfaces of different diameters. The converter further has an exterior stop which limits movement of an offset member of a mouthpiece. The second portion may include a plurality of peripheral holes for receiving offset members of the mouthpiece.

The converter may be part of a first pipe assembly which further includes a piece of PVC pipe having a first end within the first hole and a closed second end. The first pipe assembly would further include a mouthpiece attached to the converter by offset members. A plurality of pipe assemblies like the first pipe assembly together form a calliope.

An air pipe and a valve having a valve member are used with the valve disposed to individually control air flow to the mouthpiece. An adjuster is used for adjusting a limit on travel of the valve member to limit air which may flow through the valve. A pneumatic actuator mounted to support arm attached to the valve is operably connected to control the valve. The adjuster is a screw which limits travel of the pneumatic actuator.

The present invention may alternately be described as a musical instrument with a first pipe assembly. The first pipe assembly includes a converter having a first portion with a generally cylindrical first hole, a second portion with a second hole therein, the second hole being in line with the first hole, and an interior stop in between the first hole and the second hole, the second portion having a cylindrical outer edge which is beveled outwardly. A pipe has a first and extending into the first hole and a closed second end. A mouthpiece is mounted to the converter by offset members. The mouthpiece has a side wall and a disc mounted therein such that air may escape between the disc and the side wall for causing a resonance in the pipe. A cap closes off the second end of the pipe. The cap has a floor and an outer portion which fits around the second end of the pipe. The pipe is preferably a PVC pipe. The second portion includes a plurality of peripheral holes into which the offset members are disposed.

The present invention may alternately be described as a method of making a musical instrument including the closing off of one end of a PVC pipe and the inserting of the other end of the PVC pipe into a generally cylindrical first hole of a first portion of a converter. The converter has a second portion with a second hole therein, the second hole in line with the first hole. The converter further has an interior stop in between the first hole and the second hole and the second portion has a cylindrical outer edge which is beveled outwardly. A further step is the mounting of a mouthpiece to the convertor by way of offset members, the mouthpiece having a side wall and a disc mounted therein such that air may escape between the disc and the side wall and cause a resonance in the PVC pipe. The closing off step is accomplished by mounting a cap on one end of the PVC pipe, the cap having a floor and an outer portion which fits around the second end of the pipe.

BRIEF DESCRIPTION OF THE DRAWINGS

The above and other features of the present invention will be more readily understood when the following detailed description is considered in conjunction with the accompanying drawings wherein like characters represent like parts throughout the several views and in which:

FIG. 7 shows an exploded side view of a valve housing together with a valve member;

FIG. 8 shows a front view of the valve member of FIG. 7;

FIG. 9 shows a top exploded view of the valve body and valve member of FIG. 7;

FIG. 10 shows an exploded side view of a mouthpiece and coupler according to a second embodiment of the present invention; and FIG. 11 shows a top view of the coupler of FIG. 10.

DETAILED DESCRIPTION

Figure 1:
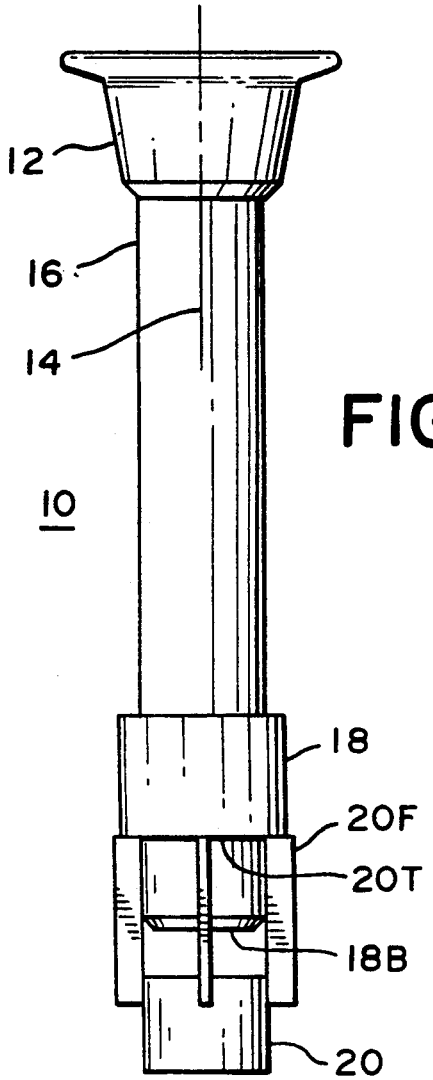
FIG. 1 shows a calliope pipe according to the present invention.
Figure 2:
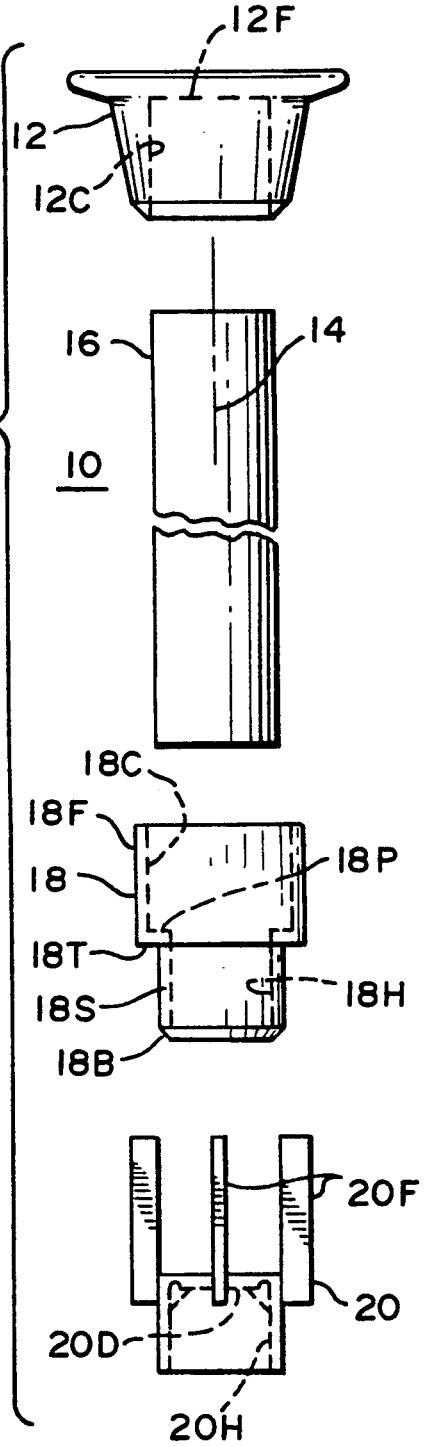
FIG. 2 shows an exploded view of the parts of the calliope pipe of FIG. 1.

As shown in FIGS. 1 and 2, a calliope pipe or pipe assembly 10 according to the present invention includes a cap 12. The cap 12 is generally cylindrical and is symmetric about an axis of symmetry 14 as are the other components of FIG. 1 and 2. The cap 12 has one end of a tube or pipe 16 disposed therein. In particular, the tube 16, which preferably is a PVC pipe, extends to within a cylindrical cavity 12C (FIG. 2 only, tube 16 shown removed from the cavity). The tube 16 may be held within the cavity 12C by a friction fit or, alternately, may be glued within the cavity. Although the tube 16 would normally have its end abut a floor 12F (FIG. 2 only) of the cavity, one might alternately adjust the tone of the pipe assembly 10 by moving the end cap 12 relative to the pipe 16. In other words, one can slightly offset the floor 12F from the end of tube 16 before gluing to change the frequency of the note which will be sounded. Although the cavity 12C is generally cylindrical, one might optionally put a slight taper on its side walls such that the fit between the tube 16 and the cap 12 will be more snug the closer the end of the tube 16 gets to the floor 12F.

Mounted at the end of tube 16 opposite the cap 12 is a coupler 18. The coupler 18, which is also referred to as a converter since it converts a PVC pipe 16 into a resonance cavity to serve as a musical or sound pipe, has a first portion 18F having a cylindrical outer surface. The first portion 18F has a generally cylindrical first hole 18C disposed therein to accommodate one end of the tube 16. The first hole 18C is in line and concentric with a second hole 18H disposed in a second portion 18S of the coupler 18. The second portion 18S is generally cylindrical and has a slightly reduced outside diameter from that of the first portion 18F. The first portion 18F is separated from the second portion 18S by an annular exterior stop or shoulder 18T. The first hole 18C, which may be tapered slightly such that the tube 16 fits more snugly as it is pushed further into the hole, is separated from the second hole 18H by an annular interior shoulder stop 18P. However, there is free communication between the hole 18H and the hole 18C throughout the complete cross-sectional area of hole 18H. Indeed, when the coupler 18 is connected to the tube or pipe 16, the interior diameter of the pipe 16 may equal the interior diameter of the hole 18H such that the interior of pipe 16 essentially becomes a continuation of the hole 18H with no boundary in between the tube. The tube 16 may simply be a friction fit within the hole 18C and up against the interior stop 18P. Alternately, one might use glue or other techniques to secure the coupler 18 relative to the tube 16.

Figure 3:
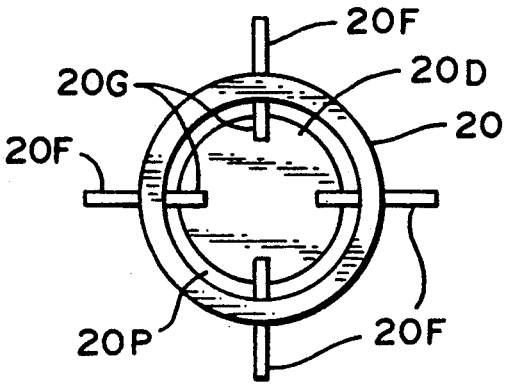
FIG. 3 shows a view of the bottom of a mouthpiece as used the present invention.

The coupler 18 would, like the cap 12, preferably be a plastic-molded article made using injection molding techniques. Continuing to consider FIGS. 1 and 2, but also referring now to the bottom view of FIG. 3, a mouthpiece 20 according to the present invention will be described. The mouthpiece 20, which is generally cylindrical and made of injection molded plastic, has four offset members 20F which allow the bulk of the mouthpiece 20 to be offset from a circular, beveled lower edge 18B (FIG. 2 only) of the coupler 18. Specifically, the offset members 20F may be glued or otherwise adhered to the cylindrical exterior of portion 18S with ends of the offset members 20F abutting the exterior stop 18T. Inside of mouthpiece 20 is a cylindrical hole 20H which is open at its bottom and has a disc 20D partially closing its top. As shown in FIG. 3, the disc 20D is offset from the sides of the coupler 20 by four gussets 20G so as to define four openings 20P, each opening extending about 90° in an arc around the outside of the disc 20D.

The operation of the assembly 10 is relatively straightforward. The assembly may be used as a calliope pipe or simply as a sound pipe or musical pipe which may be actuated by blowing into the open end of the mouthpiece 20. Whether used as a simple mouthpiece musical pipe or as a musical pipe for a calliope or similar instrument, pressurized air is supplied to the hole 20H. Some of the pressurized air escapes through the openings 20P and interacts with the beveled edge 18B to sound a note corresponding to the resonance of tube 16. By slightly moving the cap 12 relative to the tube 16 and/or slightly moving the coupler 18 relative to the tube 16, one can make adjustments in the pitch or frequency of the particular assembly 10. Those minor adjustments may change the effective length of the resonance cavity which includes the tube 16.

Advantageously, by using a coupler 18, one can produce a large number of notes without having to make a beveled edge such as 18B in each tube corresponding to each of the notes. Instead, one can use standard PVC pipe, which is readily cut, together with the coupler 18 to provide a large number of notes. Since the cap 12 and coupler 18 may be used to make minor adjustments in frequency of the assembly, one need not be especially precise about the cuts in the PVC pipe used to make the tube 16. For some designs of calliopes, it may be advisable to have some notes made using PVC pipe of one diameter and other notes made using PVC pipe of a different diameter. In that case, one would make end caps 12, couplers 18 and mouthpieces 20 in two different sizes, one size corresponding to each of the diameters of PVC pipe. However, one has avoided the necessity of making a beveled edge tube corresponding to a single note.

Figures 4, 5, 6:
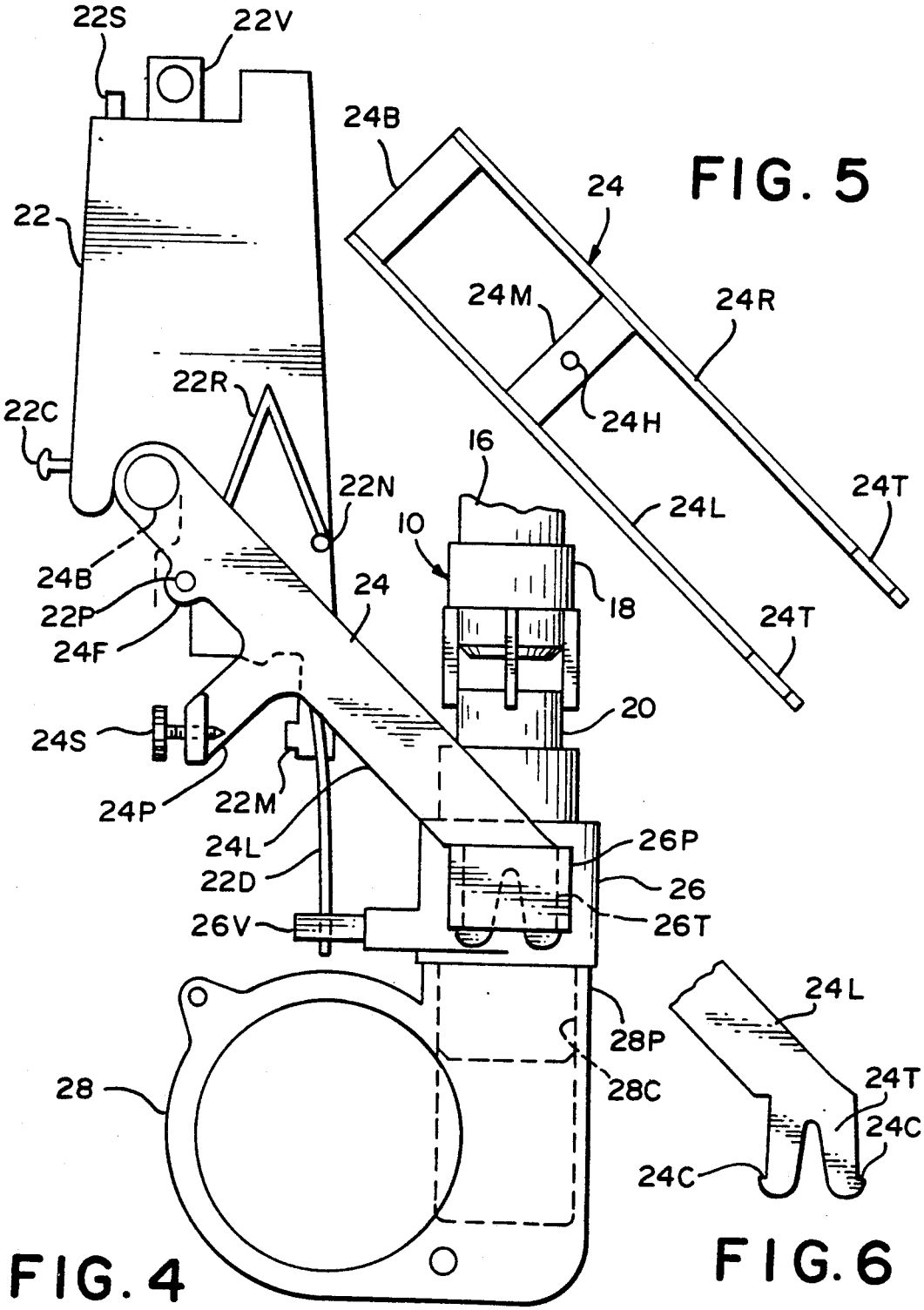
FIG. 4 shows a side view of the calliope pipe mounted on a valve assembly and associated parts.
FIG. 5 shows a top view of a support arrangement for supporting a pneumatic actuator upon the valve assembly.
FIG. 6 shows a side view of a part of the support assembly of FIG. 5.

Turning now to FIG. 4, some parts of pipe assembly 10 have been broken away, but the remaining parts illustrate how the pipe assembly 10 is mounted before activation by a pneumatic actuator 22 shown in simplified form. The pneumatic actuator 22 may be constructed identically and operate identically to the pneumatic actuator disclosed in the present inventor's prior U.S. Pat. No. 4,619,177 issued on Oct. 28, 1986. That prior patent is hereby incorporated by reference.

Before pointing out several minor differences between the preferred pneumatic 22 of FIG. 4 and the pneumatic of the incorporated by reference patent, it should briefly be noted that the pneumatic 22 allows activation of the pipe assembly 10 by operation of a player piano paper tape reading mechanism. Such a mechanism is further disclosed in the present inventor's prior U.S. Pat. No. 4,733,592 issued on Mar. 29, 1988 and hereby incorporated by reference.

In addition to the minor differences in shape, the pneumatic actuator 22 of FIG. 4 is different from that disclosed in the '177 patent in that the signal tube 22S and the vacuum 22V are arranged in slightly different fashion. Additionally, the screw 22C is mounted in a slightly different arrangement from that of the screw 118 in FIG. 2A of the '177 patent. However, the screw 22C functions in the same way to secure the pneumatic 22 against a bar 24B. The pneumatic 22 is further slightly different in that a plastic spring 22R into an open or non-actuated position. The spring 22R may simply include two pins 22N (only one visible in FIG. 4) which would be secured to the upper and lower body pieces of the pneumatic (corresponding to pieces 124 and 128 of FIG. 2A of the '177 patent.)

The pipe assembly 10 is mounted with its mouthpiece 20 extending to within a valve 26. The valve 26 controls air flow from a pipe 28. The interior of the pipe 28 contains pressurized air whenever the calliope is turned on. The pressurized air may flow through a cavity 28C which extends in an upwardly extending portion 28P. The tube like portion 28P may extend to within the valve 26. When the valve 26 is opened in the manner which will be discussed in detail below, pressurized air is provided to the mouthpiece 20 of pipe assembly 10 causing the pipe assembly 10 to sound its note.

Mounted to opposite sides of the valve 26 is a support assembly 24 having essentially identical right and left support arms 24R and 24L (see also FIG. 5, only 24L visible in FIG. 4). Referring to FIGS. 5 and 6 in combination with FIG. 4, the bottom of each of the members 24R and 24L includes a latch 24T which may be squeezed together and inserted in a pocket 26P on valve 26. The latch 24T is squeezed together such that the corresponding member 24L or 24R is secured to valve 26 when the catches 24C catch on the bottom of the pocket 26P. Other mounting arrangements for the members 24R and 24L could be used. In any case, the members 24L and 24R extend upwardly and have a cross tube 24B mounted thereto such that the screw 22C may secure the pneumatic 22 to the cross tube 24B. Additionally, a flange 24F may have a hole in which a locating pin 22P may be disposed. The locating pin 22P may simply be a pin projecting out from the side of the pneumatic 22. If desired, the locating pin 22P could be on one side of the pneumatic and the spring 22R could have a pin in registry on the other side of the pneumatic. In that case, one end of the spring 22R could be secured to the flange 24F.

In addition to mounting the pneumatic 22, the support assembly 24 includes two projections 24P (FIG. 4 only, only one visible) projecting from each of the two identically-constructed members 24L and 24R. A cross member 24M extends between the two projections 24P and has a hole 24H (FIG. 5) in which a screw 24S may be disposed. The screw 24S serves as an adjuster to limit the travel of the pneumatic 22. That is, when the pneumatic is contracted, the member 22M will be drawn leftwardly in the view of FIG. 4. By adjusting the screw 24S, the extent of leftward movement of member 22M will be reduced. This will in turn reduce the travel of a valve member 26B which moves with member 22M since rod or member 22D is mounted to member 22M and extends through a hole in valve member or valve blade 26V. By adjusting the screw 26S and limiting the travel of valve member 26V, one can adjust the air flow to a particular pipe assembly 10 and change the relative volume of that pipe assembly individually. In other words, one can change the volume of that pipe assembly without changing the sound level of the other pipe assemblies. It will be readily appreciated that numerous of the pipe assemblies 10 would be mounted at different locations along the length of the pipe 28.

Turning now to FIGS. 7, 8, and 9, the details of construction of the valve 26 will be discussed. The valve member or blade 26V has a hole 26H in which the rod 22D (not shown in FIGS. 7, 8, or 9) can be placed. The valve member further includes an opening 26N which allows air to flow therethrough when that opening 26N is in registry with in line and identically sized openings 26L (FIG. 9). The blade or valve member 26V fits within a slot 26S having upper and lower walls which separate an upper cylindrical cavity 26U from a lower cylindrical cavity 26B.

Continuing to view FIGS. 7, 8, and 9, but also referring back to FIG. 4, when the pneumatic 22 is in its expanded or non-actuated state as shown, the valve member 26V will block the openings 26L. When the pneumatic 22 is actuated, the valve member 26V will travel or move until it is at least partly clear of the openings 26L, thus allowing air to flow through the valve. The extent of air flowing through the valve will depend upon the overlap of member 26V and openings 26N and 26L. This in turn depends upon the setting of the adjuster screw 24S, which therefore may be used to individually set the volume of a particular pipe assembly.

As shown in FIGS. 7, 8, and 9, each of the pockets 26P includes a downwardly extending slot 26T in which the latch portion 24T (FIG. 6) may be disposed.

Turning now to FIGS. 10 and 11, an alternate construction coupler and mouthpiece will be discussed. The converter or coupler 30 of FIGS. 10 and 11 is a cylindrical coupler having two in-line and slightly different diameter cylindrical cavities as described in more detail in connection with the coupler 18. The outside of coupler 30 is different in that it includes four lugs 30L spaced around it, each lug including a hole 30H into which a portion of an offset member 32F of mouthpiece 32 may be disposed. As shown in FIG. 10, the mouthpiece 32 includes a disc 32D and four gussets 32G essentially identical to the disc and gusset arrangement discussed above with respect to FIG. 3. The offset members 32F are preferably rod-like members having a reduced diameter corresponding to the holes 30H for a portion of the offset members. In addition to the different shape of the offset members 32F to correspond to the holes 30H of lugs 30L, the mouthpiece 32 may be different from the mouthpiece 20 in another respect. Specifically, the mouthpiece 32 may be made of two pieces 32U and 32L such that the cylindrical upper piece 32U may fit within an upper portion of the cylindrical lower piece 32L. By adjusting the offset between the upper piece 32U and shoulder stop 32S of piece 32L before gluing, one can determine the amount of pressure at which the mouthpiece will work best. Thus, an offset of ½ inch might correspond to 30 lbs. and an offset of ¾ inch might be used for 100 lbs. of air pressure.

The arrangement of FIGS. 10 and 11 would essentially function the same as the arrangement as FIGS. 1-3. A PVC pipe (not shown) would be disposed within the coupler 30 and might be disposed against an annular interior stop 30P. The offset members 32F may allow member 32U to be secured to converter 30 without requiring glue as the fitting of a portion of offset members 32F within the holes 30H provides a more secure connection than the arrangement of FIG. 2. In other words, the arrangement of FIG. 2 would normally require glue to hold the offset members 20F in place, whereas the arrangement of FIGS. 10 and 11 would function without necessarily requiring glue for that connection. The member 32L could be secured to the member 32U by a friction fit or by other means.

Although various details have been discussed herein, it is to be understood that these are for illustrative purposes only. Various adaptations and modifications will be apparent to those of skill in the art. Accordingly, the scope of the present invention should be determined by reference to the claims appended hereto.

What is claimed:

1. A musical instrument comprising a first pipe assembly including:

a converter having a first portion with a generally cylindrical first hole therein, a second portion with a second hole therein, said second hole in line with said first hole, and an interior stop in between said first hole and said second hole, said second portion having a cylindrical outer edge which is beveled outwardly;

a pipe having a first end extending into said first hole and a closed second end; and a mouthpiece with a side wall and a disc mounted therein such that air may escape between the disc and the side wall for causing a resonance in said pipe, said mouthpiece mounted to said converter by offset members.

2. The musical instrument of claim 1 further comprising a cap which closes off said second end of said pipe, said cap having a floor and an outer portion which fits around said second end of said pipe.

3. The musical instrument of claim 1 wherein said pipe is a PVC pipe.

4. The musical instrument of claim 1 wherein said second portion includes a plurality of peripheral holes into which said offset members are disposed.

5. The musical instrument of claim 1 further comprising a plurality of said first pipe assembly, each assembly having a converter, a PVC pipe and a mouthpiece, said plurality of assemblies forming a calliope.

6. The musical instrument of claim 1 further comprising an air pipe and a valve having a valve member, said valve disposed to individually control air flow to said mouthpiece.

7. The musical instrument of claim 6 further comprising an adjustor for adjusting a limit on travel of said valve member to limit air which may flow through said valve.

8. The musical instrument of claim 7 further comprising a pneumatic actuator mounted to a support arm attached to said valve, said pneumatic actuator operably connected to control said valve, and wherein said adjustor is a screw which limits travel of said pneumatic actuator.

9. A method of making a musical instrument comprising the steps of:

closing off one end of a PVC pipe;

inserting another end of the PVC pipe into a generally cylindrical first hole of a first portion of a converter, said converter further having a second portion with a second hole therein, said second hole in line with said first hole, and an interior stop in between said first hole and said second hole, said second portion has a cylindrical outer edge which is beveled outwardly; and mounting a mouthpiece to said converter by way of offset members, said mouthpiece having a side wall and a disc mounted therein such that air may escape between the disc and the side wall and cause a resonance in said PVC pipe.

10. The method of claim 9 wherein said closing off step is accomplished by mounting a cap on said one end of said PVC pipe, said cap having a floor and an outer portion which fits around said second end of said PVC pipe.

* * * * *